US010049781B2

(12) United States Patent
Garcia et al.

(10) Patent No.: US 10,049,781 B2
(45) Date of Patent: Aug. 14, 2018

(54) LOW FIRING SILVER CONDUCTOR

(71) Applicant: Heraeus Precious Metals North America Conshohocken LLC, West Conshohocken, PA (US)

(72) Inventors: Virginia C. Garcia, Carteret, NJ (US); Matthew Sgriccia, Douglassville, PA (US); Mark Challingsworth, Glenside, PA (US)

(73) Assignee: Heraeus Precious Metals North America Conshohocken LLC, West Conshohocken, PA (US)

( * ) Notice: Subject to any disclaimer, the term of this patent is extended or adjusted under 35 U.S.C. 154(b) by 0 days.

(21) Appl. No.: 14/161,070

(22) Filed: Jan. 22, 2014

(65) Prior Publication Data

US 2014/0220363 A1 Aug. 7, 2014

Related U.S. Application Data

(60) Provisional application No. 61/759,769, filed on Feb. 1, 2013.

(51) Int. Cl.
*H01B 1/02* (2006.01)
*H01B 1/22* (2006.01)

(52) U.S. Cl.
CPC ..... *H01B 1/22* (2013.01)

(58) Field of Classification Search
CPC ..... H01L 31/022425; H01B 1/22; H01B 1/02; Y02E 10/50; C04B 41/009; C03C 8/08
USPC ..... 252/514
See application file for complete search history.

(56) References Cited

U.S. PATENT DOCUMENTS 4,904,415 A * 2/1990 Lau ..... C03C 3/142 106/1.12
4,962,066 A * 10/1990 Starz et al. ..... 501/19
5,198,154 A * 3/1993 Yokoyama ..... B22F 1/025 252/512

(Continued)

FOREIGN PATENT DOCUMENTS

EP 1 339 073 8/2003
EP 2 323 171 5/2011

(Continued)

*Primary Examiner* — William D Young
(74) *Attorney, Agent, or Firm* — Blank Rome LLP; Charles R. Wolfe, Jr.; Cole T. Duncan

(57) ABSTRACT

The invention provides an electroconductive paste comprising metallic particles and an organic vehicle comprising an aldehyde resin and a solvent. The invention also provides an electroconductive paste comprising metallic particles comprising at least two types of metallic particles selected from the group consisting of a first metallic particle having an average particle size $d_{50}$ of at least about 1 μm and no more than about 4 μm, a second metallic particle having a $d_{50}$ of at least about 8 μm and no more than about 11.5 μm, and a third metallic particle having $d_{50}$ of at least about 5 μm and no more than about 8 μm, and an organic vehicle. The invention further provides an article comprising a glass substrate comprising a transparent conductive oxide coating and a conductive electrode formed by applying aforementioned conductive paste on said glass substrate, and a method of producing such an article.

16 Claims, 1 Drawing Sheet

(56) References Cited

U.S. PATENT DOCUMENTS

| | | | | |
|---|---|---|---|---|
| 5,840,432 | A | 11/1998 | Hirai et al. | |
| 6,198,618 | B1 * | 3/2001 | Ohtani | C03C 8/18 361/301.4 |
| 6,225,392 | B1 * | 5/2001 | Sunahara | 524/404 |
| 6,372,158 | B1 * | 4/2002 | Hashimoto et al. | 252/514 |
| 7,727,424 | B2 * | 6/2010 | Konno | H01B 1/02 106/1.14 |
| 2008/0268637 | A1 * | 10/2008 | Inaba | H01B 1/22 438/660 |
| 2009/0146117 | A1 * | 6/2009 | Suenaga et al. | 252/520.3 |

FOREIGN PATENT DOCUMENTS

| | | | |
|---|---|---|---|
| EP | 2 455 947 | | 5/2012 |
| JP | H10312712 | A | 11/1998 |
| JP | 2003016838 | A | 1/2003 |
| JP | 2008047487 | A | 2/2008 |

* cited by examiner

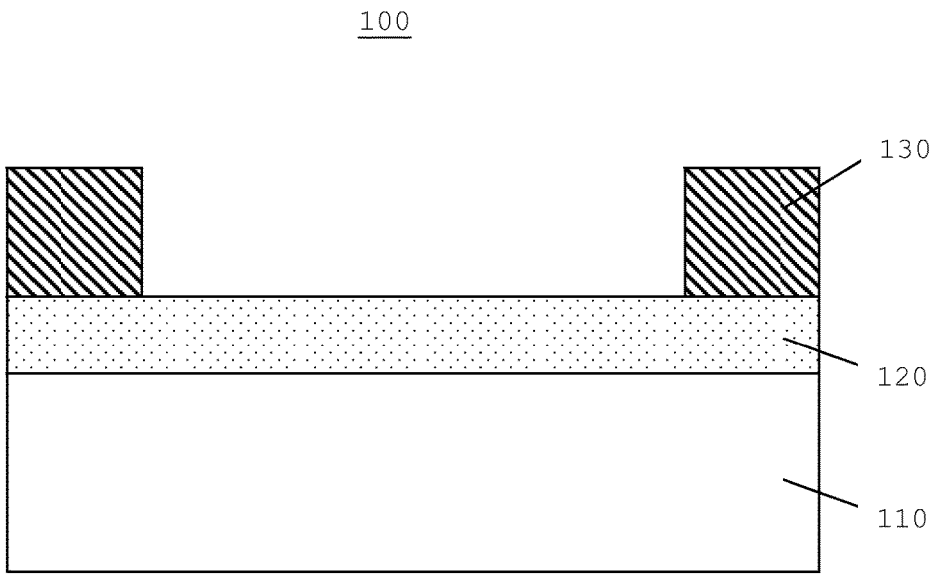
100
130
120
110

LOW FIRING SILVER CONDUCTOR

RELATED APPLICATION

This application claims priority under 35 U.S.C. § 119 to U.S. Provisional Application No. 61/759,769, filed Feb. 1, 2013, the entire disclosure of which is incorporated herein by reference.

TECHNICAL FIELD

The application relates to a low firing temperature electroconductive paste composition for forming electrodes on a glass substrate. The glass substrate may comprise a transparent conductive coating. In one application, the paste composition can be used in the manufacture of dynamic windows which, when subjected to a low voltage of electricity, become tinted.

BACKGROUND

Tinted glass has been used in a variety of household, commercial, and automotive applications for many decades. Tinted glass helps to reduce the amount of infrared light, visible light, and ultraviolet radiation that is transmitted through transparent glass windows. Tinted windows are typically formed by applying a tinting film to a standard glass window. The composition of the film may vary depending on the desired absorbance of the glass, the size of the glass pane, the thickness of the glass, the construction of the glass window, or the desired application of the glass window.

A recent improvement in tinted window technology is the development of switchable or "dynamic" glass windows. Specifically, coatings on the dynamic glass surface undergo a solid-state reaction when a low voltage is applied to them. The voltage causes a reaction within the coatings, which in turn causes the assembly to darken. The darkened state enables the glass to absorb and reflect heat and glare from the sun. When the voltage is removed, the glass is returned to its clear state, which allows complete absorption of the sun's light.

Transparent conductive coatings are typically applied to the surface of the glass to facilitate electrical conduction. In addition, an electrode formed of an electroconductive paste is typically printed or dispensed around the periphery of the glass to facilitate the flow of electricity to the layered materials. Electroconductive pastes, such as, for example, silver pastes, have traditionally been used to produce these conductive electrodes on glass substrates. An electroconductive paste typically comprises metallic particles, glass frit(s), and an organic vehicle. Once the electroconductive paste is printed or dispensed on the glass, it is typically then fired at an elevated temperature to form the resulting electrode.

The electroconductive paste must adhere well to the glass substrate, and must be able to be fired at relatively low temperatures, to ensure the stability and integrity of the other components. The firing temperature is typically lower (e.g., 300-500° C.) than the firing temperature of electroconductive pastes used in LED, hybrid circuit, and solar cell technology (e.g., 800° C. or above). At such low firing temperatures, achieving adequate adhesion to the glass substrate and low resistivity is difficult. Therefore, an electroconductive paste which has optimal conductive properties, adheres well to a glass substrate, and can be processed at relatively low temperatures, is desired.

SUMMARY

The invention provides an electroconductive paste which achieves low resistivity and sufficient adhesion to a glass substrate, which may be fired at temperatures of about 400° or less.

One aspect of the invention relates to an electroconductive paste comprising metallic particles and an organic vehicle comprising an aldehyde resin and a solvent. According to one embodiment, the aldehyde resin is a condensation product of urea and aliphatic aldehydes. According to another embodiment, the aldehyde resin is about 5-50% wt. % of electroconductive paste, preferably 10-20 wt. % of electroconductive paste.

According to another embodiment of the invention, the metallic particles comprise at least two types of metallic particles selected from the group consisting of a first metallic particle having an average particle size of approximately 1-4 μm, a second metallic particle having an average particle size of approximately 8-12 μm, and a third metallic particle having an average particle size of approximately 5-8 μm.

The invention also provides an electroconductive paste comprising metallic particles comprising at least two types of metallic particles selected from the group consisting of a first metallic particle having an average particle size of approximately 1-4 μm, a second metallic particle having an average particle size of approximately 8-11.5 μm, and a third metallic particle having an average particle size of approximately 5-8 μm, and an organic vehicle.

According to one embodiment, the metallic particles are about 30-95 wt. % of electroconductive paste, preferably about 40-80 wt. % of electroconductive paste, and more preferably about 55-75 wt. % of electroconductive paste. According to a further embodiment, the first metallic particle is about 5-95 wt. % of electroconductive paste, preferably 20-50 wt. %, and most preferably 30-40 wt. %. The second metallic particle is about 5-95 wt. % of electroconductive paste, preferably 10-40 wt. % of electroconductive paste, and most preferably 20-30 wt. %. Lastly, the third metallic particle is about 5-95 wt. % of electroconductive paste, preferably 0.1-20 wt. % of electroconductive paste, and most preferably 0.1-10 wt. %.

According to a further embodiment, the metallic particles are selected from the group consisting of silver, copper, aluminum, zinc, palladium, platinum, gold, iridium, rhodium, osmium, rhenium, ruthenium, nickel, lead, and mixtures of at least two thereof. Preferably, the metallic particles are silver.

According to another embodiment, the electroconductive paste further comprises a glass frit. According to a further embodiment, the glass frit has a glass transition temperature of 200-350° C. According to yet another embodiment, the glass frit is less than 1 wt. % of electroconductive paste, preferably 0.1-0.6 wt. % of electroconductive paste.

According to one embodiment, the organic vehicle is about 10-60 wt. % of electroconductive paste, preferably about 15-40 wt. % of electroconductive paste. According to another embodiment, the electroconductive paste further comprises a thixotropic agent. According to a further embodiment, the thixotropic agent is about 0.1-1 wt. % of electroconductive paste.

The invention also provides an article comprising a glass substrate comprising a transparent conductive oxide coating and an electroconductive electrode formed by applying the electroconductive paste of the invention on said glass substrate. According to another embodiment, the transparent conductive oxide coating is formed of a material selected from the group consisting of indium tin oxide, fluorine doped tin oxide, and doped zinc oxide.

The invention also provides a method of producing the article according to the invention, comprising the steps of providing a glass substrate comprising a transparent conductive oxide coating, applying an electroconductive paste according to the invention to said glass substrate, and firing said glass substrate with applied electroconductive paste at or below a peak temperature of 450° C., preferably about 400° C. or less. The dwell time at peak temperature is less than about 10 min, preferably for about 3-5 minutes.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

FIG. 1 is an exemplary illustration of conductive electrodes formed on a glass substrate according to an exemplary embodiment of the invention.

DETAILED DESCRIPTION

The invention is directed to an electroconductive paste composition. While not limited to such an application, such a paste may be used to form conductive electrodes on glass substrates. The glass substrate may comprise a transparent conductive coating, which may be used for the production of dynamic glass for tinted windows. A desired paste for this application has optimal electrical properties and adheres well to the underlying glass substrate. Most importantly, the paste should be able to be fired at relatively low temperatures (e.g., 300-500° C.) as compared to electroconductive pastes used in other applications, such as LED assemblies, hybrid circuits, and solar cells (e.g., 800° C. or above).

Electroconductive Paste

One aspect of the invention is an electroconductive paste comprising metallic particles and an organic vehicle. The electroconductive paste may comprise at least 30 wt % metallic particles, preferably at least 40 wt %, and most preferably at least 55 wt %, based upon 100% total weight of the paste. At the same time, the electroconductive paste may comprise no more than about 95 wt % metallic particles, preferably no more than about 80 wt %, and most preferably no more than about 75 wt %, based upon 100% total weight of the paste. The organic vehicle makes up at least 10 wt % of the paste, and preferably at least 25 wt % of the paste, based upon 100% total weight of the paste. At the same time, the organic vehicle is no more than about 60 wt % of the paste, and preferably no more than about 40 wt % of the paste, based upon 100% total weight of the paste.

Metallic Particles

Preferred metallic particles are those which exhibit metallic conductivity or which yield a substance which exhibits metallic conductivity when fired. Metallic particles present in the electroconductive paste cause the solid electrode, which is formed when the electroconductive paste is sintered when fired, to be conductive. Metallic particles which favor effective sintering and which yield electrodes with high conductivity and low contact resistance are preferred. Metallic particles are well known in the art. Preferred metallic particles are metals, metal resinates, mixtures of metal resinates, mixtures of at least one metal and a metal resinate, mixtures of at least one metal and at least one metal resinate, mixtures of at least one metal and metal resinates, alloys, mixtures of at least two metals, mixtures of at least two alloys, or mixtures of at least one metal with at least one alloy.

Preferred metals which may be employed as metallic particles according to the invention are silver, copper, aluminum, zinc, palladium, platinum, gold, iridium, rhodium, osmium, rhenium, ruthenium, nickel, lead and mixtures of at least two thereof. Preferred alloys which may be employed as metallic particles are alloys containing at least one metal selected from the list of silver, copper, aluminum, zinc, palladium, platinum, gold, iridium, rhodium, osmium, rhenium, ruthenium, nickel, lead, or mixtures of two or more of those alloys.

In one embodiment according to the invention, the metallic particles comprise a metal or alloy coated with one or more different metals or alloys, for example copper coated with silver.

In a preferred embodiment, the metallic particles comprise silver. The metallic particles may be present as elemental metal, one or more metal derivatives, or a mixture thereof. Suitable silver derivatives include, for example, silver alloys and/or silver salts, such as silver halides (e.g., silver chloride), silver nitrate, silver acetate, silver trifluoroacetate, silver orthophosphate, silver mercaptide, silver carboxylate and combinations thereof.

It is well known in the art that metallic particles can exhibit a variety of shapes, surfaces, sizes, and surface area to volume ratios. A large number of shapes are known to the person skilled in the art. Some examples include, but are not limited to, spherical, angular, elongated (rod or needle like) and flat (sheet like). Metallic particles may also be present as a combination of particles of different shapes. Metallic particles with a shape, or combination of shapes, which favors advantageous sintering, electrical contact, adhesion and electrical conductivity of the produced electrode are preferred. One way to characterize such shapes without considering surface nature is through the following parameters: length, width and thickness. In the context of the invention, the length of a particle is given by the length of the longest spatial displacement vector, both endpoints of which are contained within the particle. The width of a particle is given by the length of the longest spatial displacement vector perpendicular to the length vector defined above both endpoints of which are contained within the particle.

In one embodiment according to the invention, metallic particles with shapes as uniform as possible are preferred (i.e. shapes in which the ratios relating the length, the width and the thickness are as close as possible to 1, preferably all ratios lying in a range from about 0.7 to about 1.5, more preferably in a range from about 0.8 to about 1.3 and most preferably in a range from about 0.9 to about 1.2). Examples of preferred shapes for the metallic particles are spheres and cubes, or combinations thereof, or combinations of one or more thereof with other shapes. In another embodiment according to the invention, metallic particles are preferred which have a shape of low uniformity, preferably with at least one of the ratios relating the dimensions of length, width and thickness being above about 1.5, more preferably above about 3 and most preferably above about 5. Preferred shapes according to this embodiment are flake shaped, rod or needle shaped, or a combination of flake shaped, rod or needle shaped with other shapes. In another preferred embodiment, a combination of metallic particles with uniform shape and less uniform shape is desired. Specifically, a combination of spherical metallic particles and flake-shaped metallic particles, having different particle sizes, which may include nano size particles, is preferred.

According to one embodiment, the metallic particles are silver. The silver particles may be in the form of silver powder, silver flakes, or silver resinate, and may also be a mixture or blend of powder and flakes of different particle sizes, or a mixture of a blend of powder and flakes, or a mixture of powder, flakes, and a silver resinate. The resinate may be in the form of a powder or solution with a metal content of at least about 10%, and preferably at least about 20%, and no more than about 50%, preferably no more than about 38%. In one embodiment, the silver particles are a mixture of at least two types of silver particles of different size, shape, or surface characteristics. In a preferred embodiment, the metallic particles may comprise a combination of spherical silver particles, flake-shaped silver particles, or a mixture thereof, each having different particle size and surface characteristic.

A variety of surface types of the metallic particles are known in the art. Surface types which favor effective sintering and yield advantageous electrical contact and conductivity of the produced electrodes are favored according to the invention.

Another way to characterize the shape and surface of a metallic particle is by its specific surface area. Specific surface area is a property of solids equal to the total surface area of the material per unit mass, solid or bulk volume, or cross sectional area. It is defined either by surface area divided by mass (with units of $m^2/g$ or $m^2/kg$), or surface area divided by the volume (units of $m^2/m^3$ or $m^{-1}$) The lowest value for the specific surface area of a particle is embodied by a sphere with a smooth surface. The less uniform and uneven a shape is, the higher its specific surface area will be.

The specific surface area (surface area per unit mass) may be measured by the BET (Brunauer-Emmett-Teller) method, which is known in the art. Specifically, BET measurements are made in accordance with DIN ISO 9277:1995. A Monosorb Model MS-22 instrument (manufactured by Quantachrome Instruments), which operates according to the SMART method (Sorption Method with Adaptive dosing Rate), is used for the measurement. As a reference material, aluminum oxide (available from Quantachrome Instruments as surface area reference material Cat. No. 2003) is used. Samples are prepared for analysis in the built-in degas station. Flowing gas (30% $N_2$ and 70% He) sweeps away impurities, resulting in a clean surface upon which adsorption may occur. The sample can be heated to a user-selectable temperature with the supplied heating mantle. Digital temperature control and display are mounted on the instrument front panel. After degassing is complete, the sample cell is transferred to the analysis station. Quick connect fittings automatically seal the sample cell during transfer, and the system is then activated to commence the analysis. A dewar flask filled with coolant is manually raised, immersing the sample cell and causing adsorption. The instrument detects when adsorption is complete (2-3 minutes), automatically lowers the dewar flask, and gently heats the sample cell back to room temperature using a built-in hot-air blower. As a result, the desorbed gas signal is displayed on a digital meter and the surface area is directly presented on a front panel display. The entire measurement (adsorption and desorption) cycle typically requires less than six minutes. The technique uses a high sensitivity, thermal conductivity detector to measure the change in concentration of an adsorbate/inert carrier gas mixture as adsorption and desorption proceed. When integrated by the on-board electronics and compared to calibration, the detector provides the volume of gas adsorbed or desorbed. For the adsorptive measurement, $N_2$ 5.0 with a molecular cross-sectional area of 0.162 $nm^2$ at 77K is used for the calculation. A one-point analysis is performed and a built-in microprocessor ensures linearity and automatically computes the sample's BET surface area in $m^2/g$.

In one embodiment according to the invention, metallic particles with a high specific surface area are preferred, preferably at least 2 $m^2/g$, more preferably at least 3 $m^2/g$, and most preferably at least 5 $m^2/g$. At the same time, the specific surface area is preferably no more than about 30 $m^2/g$, preferably no more than about 25 $m^2/g$, and most preferably no more than about 20 $m^2/g$. In another embodiment, metallic particles with a low specific surface area are preferred, preferably at least 0.01 $m^2/g$, more preferably at least 0.05 $m^2/g$, and most preferably at least 0.1 $m^2/g$. At the same time, the specific surface area is preferably no more than about 5 $m^2/g$, preferably no more than about 4 $m^2/g$, and most preferably no more than about 1 $m^2/g$. In one embodiment, metallic particles with a specific surface area of at least about 1 $m^2/g$ and no more than about 2 $m^2/g$ may be used.

Where silver particles are used, and preferably a mixture of different types of silver particles (as discussed herein), the specific surface area of the silver particles is preferably at least 1 $m^2/g$ and preferably no more than about 3 $m^2/g$.

The average particle size $d_{50}$ and the associated values, $d_{10}$ and $d_{90}$, are characteristics of particles well known in the art. The average particle size $d_{50}$ is the median particle diameter of a cumulative distribution of particles. It is the size at which about half of the particles in the distribution are smaller and half of the particles in the distribution are larger. The particle size $d_{10}$ corresponds to the particle size at which 10% of the particles in the distribution are smaller, and the particle size $d_{90}$ corresponds to the particle size at which 90% of the particles in the distribution are smaller.

The average particle size $d_{50}$ (and associated $d_{10}$ and $d_{90}$) may be determined by using the sedimentation technique, which measures the settling rates of differently sized particles suspended in a liquid. As used herein, $d_{50}$ is determined in accordance with ISO 13317-3:2001. A SediGraph III 5120 instrument, with software SediGraph 5120 (manufactured by Micromeritics Instrument Corp. of Norcross, Ga.), which operates according to X-ray gravitational technique, is used for the measurement. A sample of about 400 to 600 mg is weighed into a 50 ml glass beaker and 40 ml of Sedisperse P11 (from Micromeritics, with a density of about 0.74 to 0.76 $g/cm^3$ and a viscosity of about 1.25 to 1.9 mPa·s) are added as suspending liquid. A magnetic stiffing bar is added to the suspension.

The sample is dispersed using an ultrasonic probe Sonifer 250 (from Branson) operated at power level 2 for 8 minutes while the suspension is stirred with the stirring bar at the same time. This pre-treated sample is placed in the instrument and the measurement started. The temperature of the suspension is recorded (typical range 24° C. to 45° C.) and for calculation data of measured viscosity for the dispersing solution at this temperature are used. Using density and weight of the sample (10.5 $g/cm^3$ for silver) the particle size distribution is determined and given as $d_{10}$, $d_{50}$, and $d_{90}$.

It is preferred that the average particle diameter $d_{50}$ of the metallic particles is at least 1 μm. At the same time, it is preferred that the $d_{50}$ of the metallic particles be no more than about 20 μm, preferably no more than about 15 μm, more preferably no more than about 12 μm, and most preferably no more than about 10 μm. In a most preferred embodiment, the $d_{50}$ is at least 1 μm and preferably no more than about 3 μm. It is also within the invention that a mixture or blend of metallic particles of different average sizes may be use. In one embodiment, metallic particles having a $d_{50}$ of at least about 3 microns and no more than about 11.5 microns may be used.

In one embodiment, the metallic particles have a $d_{10}$ greater than about 0.1 μm, preferably greater than about 0.5 μm, and more preferably greater than about 1 μm. In one embodiment, the metallic particles have a $d_{90}$ less than about 50 μm, preferably less than about 20 μm, and more preferably less than about 15 μm. The value of $d_{90}$ should not be less than the value of $d_{50}$.

In one embodiment, the electroconductive paste comprises more than one type of silver particle. Preferably, a first silver particle having a $d_{50}$ of at least about 1 μm and no more than about 4 μm may be used. In a preferred embodiment, the first silver particle has a $d_{50}$ of about 2.5 μm. A second silver particle having a $d_{50}$ of at least about 8 μm and no more than about 12 μm may be used. In a preferred embodiment, the second silver particle has a $d_{50}$ of about 9 μm. A third silver particle having a $d_{50}$ of at least about 5 μm and no more than about 8 μm may be used. In a preferred embodiment, the third silver particle has a $d_{50}$ of about 6.5 μm. In one embodiment, any one of the above-referenced silver particles is used. In another embodiment, any two of the aforementioned silver particles are used. In a further embodiment, all three of the silver particles are used. Not bound by any particular embodiment, it is observed that combining more than one type of silver particle of different size distribution, improves conductivity of the resulting silver electrodes produced by the electroconductive paste of the invention. It is hypothesized that silver particles of different size distributions produce more compact sintering, allowing for the improved conductivity of the leads produced by pastes having a relatively low solid content.

The amount of the first type of silver particles is at least about 5 wt %, preferably at least about 20 wt %, and most preferably at least about 30 wt %, based upon 100% total weight of the paste. At the same time, the amount of the first silver particles is no more than about 95 wt %, preferably no more than about 50 wt %, and most preferably no more than about 40 wt %, based upon 100% total weight of the paste. The amount of the second type of silver particles is at least about 5 wt %, preferably at least about 10 wt %, and most preferably at least about 20 wt %, based upon 100% total weight of the paste. At the same time, the amount of the second type of silver particles is no more than about 95 wt %, preferably no more than about 40 wt %, and most preferably no more than about 30 wt %, based upon 100% total weight of the paste. The amount of the third type of silver particles is at least about 5 wt %, and preferably at least about 0.1 wt %, based upon 100% total weight of the paste. At the same time, the amount of the third type of silver particles is no more than about 95 wt %, preferably no more than about 20 wt %, and most preferably no more than about 10 wt %, based upon 100% total weight of the paste. The silver particles preferably have tap densities of at least about 2 $g/cm^3$ and no more than about 5 $g/cm^3$. Tap density was measured according to DIN EN ISO 787-11.

In one embodiment, the metallic particles may be a mixture of at least two metallic particles having different size, shape, or surface characteristics.

The metallic particles may be present with a surface coating. Any such coating known in the art, and which is considered to be suitable in the context of the invention, may be employed on the metallic particles. Preferred coatings according to the invention are those coatings that promote better particle dispersion, which can lead to improved printing and sintering characteristics of the electroconductive paste. If such a coating is present, it is preferred that the coating correspond to no more than about 10 wt. %, preferably no more than about 8 wt. %, and most preferably no more than about 5 wt. %, based upon 100% total weight of the metallic particles.

Organic Vehicle

According to one embodiment, the electroconductive paste further comprises an organic vehicle. The organic vehicle preferably comprises a resin and solvent. The resin may include, but is not limited to, an aldehyde resin, polyketone resin, polycarbonate resin, epoxy resin, polyimide resin, gum rosin, ester of hydrogenated rosin, balsams, carboxylated styrene-butadiene, and combinations thereof. The preferred organic vehicle comprises an aldehyde resin and a solvent.

Aldehyde resin is any resin produced from one or more aliphatic aldehydes by a condensation reaction brought about by concentrated alkali solutions, particularly any resinous product made by interaction of an aldehyde (e.g., formaldehyde or furfural) with another substance (e.g., phenol or urea). Aldehyde resin as a condensation product of urea and aliphatic aldehydes is preferred. The presence of the aldehyde resin is preferred in that it improves adhesion of the paste to the underlying glass substrate. The resin also allows for lower processing/firing temperatures as compared to resins used in existing electroconductive pastes. In certain applications using the electroconductive paste, a glass substrate is coated with a transparent conductive coating. The glass substrate with the transparent conductive coating must be processed at relatively low temperatures so as to allow the transparent conductive coatings to remain intact. The electroconductive paste is typically fired at peak temperature of at least 300° C., and preferably at least 375° C. At the same, the electroconductive paste is preferably fired at a peak temperature of no more than about 500° C., and preferably no more than about 425° C.

In one embodiment, the electroconductive paste preferably comprises at least about 5 wt % aldehyde resin, and more preferably at least about 10 wt % aldehyde resin. At the same time, the electroconductive paste preferably comprises no more than about 50 wt % aldehyde resin, and more preferably no more than about 20 wt % aldehyde resin. The resin may be pre-diluted in a determined amount of solvent to form a final resin concentration of at least about 40% of the resin/solvent solution, and no more than about 60% of the resin/solvent solution. Alternatively, the resin may be added directly to the paste composition.

The organic vehicle may also comprise solvent, which provides a number of important functions, including improving the viscosity, printability, contact properties and drying speed and rate of the electroconductive paste, to name a few. Any solvent known to one skilled in the art may be used. Common solvents include, but are not limited to, carbitol, terpineol, hexyl carbitol, texanol, butyl carbitol, butyl carbitol acetate, or dimethyladipate or glycol ethers. The solvent preferably makes up at least about 10 wt % of the paste, and preferably at least about 15 wt %, based upon 100% total weight of the paste. At the same time, the solvent preferably makes up no more than about 60 wt % of the paste, and preferably no more than about 40% wt %, based upon 100% total weight of the paste. The solvent may first be incorporated with the aldehyde resin and then added into the paste mixture, as set forth above, or the solvent may be added directly to the paste.

According to another embodiment, the organic vehicle may further comprise surfactant(s) and/or thixotropic agent(s). These components contribute to the improved viscosity, printability and contact properties of the electroconductive paste composition. Any surfactant known to one skilled in the art may be used. Common surfactants include, but are not limited to, polyethyleneoxide, polyethyleneglycol, benzotriazole, poly(ethyleneglycol)acetic acid, lauric acid, oleic acid, capric acid, myristic acid, linoleic acid, stearic acid, palmitic acid, stearate salts, palmitate salts, and mixtures thereof. Any thixotropic agent known in the art may be used, including, but not limited to, Thixatrol® MAX (manufactured by Elementis Specialties, Inc.). These components may be incorporated with the solvent and/or solvent/resin mixture, or they may be added directly into the paste composition. The thixotropic agent is preferably at least about 0.1 wt % of the electroconductive paste, and preferably no more than about 1 wt % of electroconductive paste.

The organic vehicle of the electroconductive paste may also comprise additives which are distinct from the aforementioned organic vehicle components, and which contribute to favorable properties of the electroconductive paste, such as advantageous viscosity, sintering, electrical conductivity, and contact with the glass substrate. All additives known in the art, and which are considered to be suitable in the context of the invention, may be employed as additives in the organic vehicle. Preferred additives according to the invention are adhesion promoters, viscosity regulators, stabilizing agents, inorganic additives, thickeners, emulsifiers, dispersants or pH regulators. These additives may be added directly to the paste.

Glass Frit

The electroconductive paste composition may also comprise a glass frit material. Lead-free or lead-containing glass frit may be used, including, but not limited to, lead-borate glass frit. The glass frit may be included to aid or accelerate the sintering of the metallic particles during firing, and to improve adhesion of the fired film to the glass substrate. According to one embodiment, the glass frit is preferably no more than about 5 wt % of paste, more preferably no more than about 1 wt % of paste, and most preferably no more than about 0.6 wt %, based upon 100% total weight of the paste. At the same time, the glass frit is preferably at least 0.1 wt % of the paste, based upon 100% total weight of the paste.

The glass frit preferably has a relatively low glass transition temperature ($T_g$) as compared to glasses used in other types of electroconductive pastes. At the $T_g$ of a material, an amorphous substance transforms from a rigid solid to a partially mobile undercooled melt. The glass transition temperature may be determined by Differential Scanning calorimetry (DSC) using an SDT Q600 instrument and corresponding Universal Analysis 2000 software, both available from TA Instruments-Waters LLC of New Castle, Del. An amount of about 20-30 mg of the sample is weighed into the sample pan with an accuracy of about 0.01 mg. The empty reference pan and the sample pan are placed in the apparatus, the oven is closed, and the measurement started. A heating rate of 10° C./min is employed from a starting temperature of 25° C. to an end temperature of 1000° C. The first step in the DSC signal is evaluated as the glass transition temperature $T_g$ using the software described above, and the determined onset value is taken as the temperature for $T_g$.

The desired $T_g$ of the glass frit is typically at least about 200° C., preferably at least about 250° C., and most preferably at least about 270° C. At the same time, the preferred $T_g$ of the glass frit is no more than about 400° C., preferably no more than about 350° C., and most preferably no more than about 330° C.

Another important characteristic of the glass frit is the glass softening temperature. The glass softening temperature marks the temperature at which the glass material begins to soften beyond some arbitrary softness, or the maximum temperature at which a glass can be handled without permanent deformation. The preferred glass softening temperature is at least 300° C., preferably at least 330° C. At the same time, the glass softening temperature is no more than about 500° C., preferably no more than about 400° C., and most preferably no more than about 380° C.

The glass softening temperature may be measured according to the DSC methods discussed herein.

Formation of Electroconductive Paste

To form the electroconductive paste composition, metallic particles and organic vehicle are combined using any method known in the art for preparing an electroconductive paste composition. The method of preparation is not critical, as long as it results in a homogenously dispersed paste. The components can be mixed, such as with a mixer, then passed through a three roll mill, for example, to make a dispersed uniform paste.

Formation of Electroconductive Leads on Glass Substrate

An exemplary illustration of conductive electrodes formed on a glass substrate is shown in FIG. 1. The exemplary assembly 100 comprises a glass substrate 110, a transparent conductive oxide coating 120, and conductive electrodes 130. The glass substrate 110 may be formed of any glass composition including, for example, silica-based glass. To this substrate 110, one or more conductive coatings 120 may be applied. A conductive coating is electrically conductive and can carry an electric charge. The conductive coatings may be formed of a transparent conductive oxide (TCO) material. Such materials are known in the art for these applications because they are optically transparent and electrically conductive. Inorganic transparent conductive oxide coatings may be formed from indium tin oxide (ITO), fluorine doped tin oxide (FTO), or a doped zinc oxide. The TCO may be applied to the glass substrate according to any methods known in the art, and the invention is not limited to any specific application method.

Conductive electrodes 130 may be formed on the TCO-coated glass substrate utilizing the electroconductive paste of the invention. In one example, the paste may be applied around the periphery of the glass substrate in order to build the electrode thereon. The paste may be applied in any pattern or shape that is known in the art as long as it supplies voltage to the TCO-coated glass. The electroconductive paste may be applied in any manner known to the person skilled in the art, including, but not limited to, dispensing (e.g., syringe dispensing), stenciling, impregnation, dipping, pouring, injection, spraying, knife coating, curtain coating, brush or printing, or a combination of at least two thereof, wherein preferred techniques are syringe dispensing, ink jetprinting, screen printing, or stencil printing, or a combination of at least two thereof. Preferably, the paste is applied by syringe dispensing. In screen printing applications, it is preferred that the screens have a mesh opening of at least about 50 μm, and preferably at least about 60 μm. At the same time, the screens have a mesh opening of no more than about 100 μm, and preferably no more than about 80 μm. The viscosity and rheological properties of the paste should be such that the paste is suitable for use in the given application method (e.g., dispensing, screen printing, etc.).

The applied electroconductive paste is typically first dried at temperature of at least 150° C. and no more than about 200° C. In one embodiment, the applied paste is dried for at least about 1 minute, and preferably at least about 5 minutes. At the same time, the paste is preferably dried for no longer than about 60 minutes, preferably no longer than about 30 minutes, more preferably no longer than about 15 minutes, and most preferably no longer than about 10 minutes.

After the drying step, the applied paste is then fired. According to the invention, the peak temperature for firing the substrate is 450° C. or less, and preferably about 400° C. or less. The firing step is preferably carried out in air or in an oxygen-containing atmosphere. In a typical industrial application, the firing is carried out in a box furnace, oscillating furnace, or furnace equipped with a conveyor device, such as a conveyor belt. It is preferred for total firing time at peak temperature to be at least about 3 minutes. At the same time, the total firing time at peak temperature is preferably no more than about 10 minutes, and more preferably no more than about 5 minutes. The firing may also be conducted at high transport rates, for example, about 20-30 in/min, with resulting dwell time at peak temperature of about 3-10 minutes. Multiple temperature zones, for example 3-11 zones, can be used to control the desired thermal profile.

EXAMPLE

An exemplary paste was prepared with about 69 wt % metallic particles, about 30.8 wt % organic vehicle, and about 0.2 wt. % Pb—B containing glass frit having a $T_g$ of about 300-350° C. Specifically, the metallic particles comprised, based upon 100% total weight of the paste: (1) about 33.5 wt % of a first type of silver particles having a $d_{50}$ of about 3.5 μm, an SSA of about 1.3 $m^2/g$, and a tap density of about 3.8 g/cc; (2) about 27 wt. % of a second type of silver particles having a $d_{50}$ of about 9 μm, an SSA of about 1.75 $m^2/g$, and a tap density of about 2.5 g/cc; and (3) about 8.5 wt. % of a third type of silver particles having a $d_{50}$ of about 6.5 μm, an SSA of about 1.75 $m^2/g$, and a tap density of about 3 g/cc.

The organic vehicle component of the exemplary paste comprised an aldehyde resin. A commercially available aldehyde resin, Laropal® A 81 (available from BASF Aktiengesellschaft), was used. The organic vehicle also comprised a terpineol solvent. The aldehyde resin was added to the paste composition as a pre-diluted solution. Specifically, in one batch, the resin was dissolved in terpineol, and in another batch, the resin was dissolved in butyl carbitol acetate (BCA) solvent, to a concentration of about 48%. In this particular example, terpineol-diluted Laropal® A 81 was prepared at about 24 wt % of the total paste composition, and BCA-diluted Laropal® A 81 was prepared at about 3 wt % of the total paste composition.

In addition to the two mixtures above, the organic vehicle further comprised about 0.5 wt % of a thixotropic agent and about 2.8 wt % of additional terpineol solvent, both of which were added directly into the paste composition.

The exemplary paste was applied to a glass substrate having an FTO/ITO coating via syringe dispensing. The wet paste thickness was about 50-100 μm. The glass substrate and the applied exemplary paste were processed at peak temperatures at about 400° C. or less, with a dwell time of about 5 minutes at peak temperature of about 400° C. The resulting fired electrode had a thickness of about 25-50 μm.

The silver electrode produced according to Example 1 was subjected to electrical and adhesion performance tests. The electrical testing was performed using a Hewlett Packard Multimeter system. The resistance was measured with an open circuit of fixed length and width. To calculate the sheet resistance of the fired silver electrode, the measured resistance was multiplied by the electrode film thickness and divided by the ratio of length and width of the open circuit. A desired sheet resistance is 3 mΩ/□ or less, and the silver electrode of Example 1 had a sheet resistance of about 2-3 mΩ/□ (corrected to 25 μm film thickness).

The adhesion performance testing was performed using the ASTM D3359 Cross Hatch Tape Test using Scotch Tape #8919, where the fired electrode was scratched according to an industrial standard cross hatch pattern. After the cross hatch tape test was completed, the percent paste removal was rated on a scale of 0-5, whereby a grade of 0 represents no removal and a grade of 5 represents complete removal. The silver electrode of Example 1 resulted in a grade of 0, exhibiting no paste removal.

These and other advantages of the invention will be apparent to those skilled in the art from the foregoing specification. Accordingly, it will be recognized by those skilled in the art that changes or modifications may be made to the above described embodiments without departing from the broad inventive concepts of the invention. Specific dimensions of any particular embodiment are described for illustration purposes only. It should therefore be understood that this invention is not limited to the particular embodiments described herein, but is intended to include all changes and modifications that are within the scope and spirit of the invention.

The invention claimed is:

1. An electroconductive paste comprising:

about 5% to about 95% of each of at least two types of metallic particles each having a different particle size, selected from the group consisting of a first metallic particle having an average particle size $d_{50}$ of at least about 1 μm and no more than about 4 μm, a second metallic particle having a $d_{50}$ of at least about 8 μm and no more than about 12 μm, and a third metallic particle having $d_{50}$ of at least about 5 μm and no more than about 8 μm, based upon 100% total weight of the electroconductive paste;

0.1 to 0.6 wt % of a lead-borate glass frit, based upon 100% total weight of the electroconductive paste; and an organic vehicle comprising an aldehyde resin and a solvent, wherein one of the at least two types of metallic particles is a silver resinate with a silver content of about 20% to about 50%, and wherein the glass softening temperature of the glass frit is at least about 330° C. and is no more than about 380° C.

2. The electroconductive paste according to claim 1, wherein the aldehyde resin is a condensation product of urea and aliphatic aldehydes.

3. The electroconductive paste according to claim 1, wherein the aldehyde resin is at least about 5 wt % of paste and no more than about 20 wt % of paste, based upon 100% total weight of the paste.

4. The electroconductive paste according to claim 1, wherein the organic vehicle is at least about 10 wt % of paste and no more than about 60 wt % based upon 100% total weight of the paste.

5. The electroconductive paste according to claim 1, wherein the metallic particles are metallic flakes, metallic powders, or any combination thereof.

6. The electroconductive paste according to claim 1, wherein one of the at least two types of metallic particles is selected from the group consisting of silver, copper, aluminum, zinc, palladium, platinum, gold, iridium, rhodium, osmium, rhenium, ruthenium, nickel, lead, and mixtures of at least two thereof.

7. The electroconductive paste according to claim 1, wherein the metallic particles are at least 30 wt % of paste, and no more than about 95 wt % based upon 100% total weight of the paste.

8. The electroconductive paste according to claim 1, wherein the glass transition temperature of the glass frit is at least about 200° C., and no more than about 500° C.

9. The electroconductive paste according to claim 1, wherein the first metallic particle is at least about 5 wt % of paste and no more than about 95 wt %, based upon 100% total weight of the paste.

10. The electroconductive paste according to claim 1, wherein the second metallic particle is at least about 5 wt %, and no more than about 95 wt %, based upon 100% total weight of the paste.

11. The electroconductive paste according to claim 1, wherein the third metallic particle is at least about 5 wt % and no more than about 95 wt %, based upon 100% total weight of the paste.

12. The electroconductive paste according to claim 3, wherein the aldehyde resin is at least about 10 wt % of paste and no more than about 20 wt % of paste, based upon 100% total weight of the paste.

13. The electroconductive paste according to claim 4, wherein the organic vehicle is at least about 15 wt % and no more than about 40 wt %.

14. The electroconductive paste according to claim 6, wherein the metallic particles are silver and silver resinate.

15. The electroconductive paste according to claim 7, wherein the metallic particles are at least about 40 wt % of paste and no more than about 80 wt % of paste.

16. The electroconductive paste according to claim 8, wherein the glass transition temperature of the glass frit is at least about 200° C. and no more than about 400° C.

* * * * *